US009604752B2

(12) United States Patent
Mateos Garcia

(10) Patent No.: US 9,604,752 B2
(45) Date of Patent: Mar. 28, 2017

(54) BOX WITH A LID

(71) Applicant: Agro Sevilla Aceitunas, S.C.A., Seville (ES)

(72) Inventor: Carlos Marcelino Mateos Garcia, Seville (ES)

(73) Assignee: Agro Sevilla Aceitunas, S.C.A., Sevilla (ES)

( * ) Notice: Subject to any disclaimer, the term of this patent is extended or adjusted under 35 U.S.C. 154(b) by 0 days.

(21) Appl. No.: 14/427,572

(22) PCT Filed: Sep. 9, 2013

(86) PCT No.: PCT/ES2013/070624

§ 371 (c)(1),
(2) Date: Oct. 15, 2015

(87) PCT Pub. No.: WO2014/041224

PCT Pub. Date: Mar. 20, 2014

(65) Prior Publication Data

US 2016/0068300 A1 Mar. 10, 2016

(30) Foreign Application Priority Data

Sep. 12, 2012 (ES) ..... 201200825 U

(51) Int. Cl.
*B65D 5/32* (2006.01)
*B65D 5/48* (2006.01)
(Continued)

(52) U.S. Cl.
CPC ..... *B65D 5/64* (2013.01); *B65D 5/12* (2013.01); *B65D 5/324* (2013.01); *B65D 5/4266* (2013.01);
(Continued)

(58) Field of Classification Search
CPC ..... B65D 5/64; B65D 5/4266; B65D 5/12; B65D 21/0205; B65D 5/324; B65D 5/66; B65D 5/48; B65D 5/54
(Continued)

(56) References Cited

U.S. PATENT DOCUMENTS 3,910,483 A * 10/1975 Ritter ..... B65D 5/28 229/117.16
4,084,693 A * 4/1978 Culpepper ..... B65D 5/48 206/427
(Continued)

FOREIGN PATENT DOCUMENTS

| | | |
|---|---|---|
| AU | 772378 | 4/2004 |
| DE | 9105890 | 8/1991 |
| FR | 2498561 | 7/1982 |

OTHER PUBLICATIONS

PCT Search Report and Written Opinion mailed Jan. 14, 2014, PCT Appln. No. PCT/ES2013/070624, 19 pages.

*Primary Examiner* — Gary Elkins
(74) *Attorney, Agent, or Firm* — Knobbe Martens Olson & Bear LLP

(57) ABSTRACT

The present invention relates to a box with lid which allows easy access to and removal of the product contained at the bottom or bottoms of the box, said box comprising at least one body (1) provided with cutting and folding lines demarcating a first central sector (10) forming the bottom of the body (1), and a pair of end sectors (11) corresponding to the larger sides of the body (1); further comprising a lid (2) also provided with cutting and folding lines demarcating a second central sector (3) forming the upper surface of the lid (2), and a pair of side sectors (4) corresponding to the larger sides of the lid (2), said second central sector (3) having a
(Continued)

transverse perforated line (7) and two side perforated lines (8) to allow opening the entire lid (2) or part thereof.

4 Claims, 2 Drawing Sheets

(51) Int. Cl.

| | |
|---|---|
| ***B65D 5/54*** | (2006.01) |
| ***B65D 5/66*** | (2006.01) |
| ***B65D 5/64*** | (2006.01) |
| ***B65D 21/02*** | (2006.01) |
| ***B65D 5/12*** | (2006.01) |
| ***B65D 5/42*** | (2006.01) |

(52) U.S. Cl.
CPC ..... *B65D 5/48* (2013.01); *B65D 5/54* (2013.01); *B65D 5/66* (2013.01); *B65D 21/0205* (2013.01)

(58) Field of Classification Search
USPC ..... 229/120.011, 120.03, 120.37, 125.19, 229/240, 243
See application file for complete search history.

(56) References Cited

U.S. PATENT DOCUMENTS

| | | | | | |
|---|---|---|---|---|---|
| 4,154,388 | A * | 5/1979 | Hall | B65D 5/68 | 229/125.19 |
| 4,533,052 | A * | 8/1985 | Fruchey | B65D 5/5495 | 206/805 |
| 4,715,493 | A * | 12/1987 | Dreyfus | B65D 5/46008 | 206/200 |
| 4,871,067 | A * | 10/1989 | Valenti | B65D 5/54 | 206/427 |
| 5,584,430 | A | 12/1996 | Mulry | | |
| 5,775,572 | A * | 7/1998 | Oliff | B65D 5/4802 | 229/120.03 |
| 6,371,365 | B1 * | 4/2002 | Doucette | B65D 5/5495 | 229/120.011 |
| 2009/0159488 | A1 * | 6/2009 | Grant | B65D 5/324 | 206/736 |
| 2010/0140337 | A1 * | 6/2010 | Brand | B65D 5/542 | 229/243 |

* cited by examiner

BOX WITH A LID

CROSS-REFERENCE TO RELATED APPLICATIONS

The present patent application is a national phase application of International Application No. PCT/ES2013/070624, filed Sep. 9, 2013, which claims priority to Spanish Application No. U201200825, filed Sep. 12, 2012, the disclosures of which are incorporated herein by reference.

OBJECT OF THE INVENTION

The present invention relates to a box with lid, and more specifically to a box forming a container which can be formed by a single unit or two units forming respective bases or bottoms, where they are closed in both cases by means of a lid covering the upper and side portions of the container or containers forming the box.

The object of the invention is to afford a box with lid provided with perforated lines allowing easy access to and removal of the product contained at the bottom or bottoms of the box.

The main field of application of the box is the food sector for non-portable products, without ruling out the use thereof for another type of products or articles.

BACKGROUND OF THE INVENTION

Many types of boxes, and particularly boxes incorporating a lid, are known today. However, when it comes to boxes intended for containing paper packages, for example, said boxes have a rectangular prismatic shape with an independent lid or a lid that can be punched for opening same.

In any case, there is only one box and it has a difficult-to-open lid, regardless of whether it is fixed to the box by any conventional means or if it has specific means for opening same.

DESCRIPTION OF THE INVENTION

The proposed box is preferably envisaged to be formed by two bottoms or bases closed simultaneously by means of a common lid, such that said lid is valid for when the box occupies the entire amplitude of the lid, or is likewise valid for when the box is formed by two independent bases or bottoms, each of which can contain bags of food products, for example, or any other type of different or identical products.

More specifically, the box of the invention comprises a lid formed from the net of a rectangular sheet with folding lines demarcating a central or upper sector with a transverse perforated line and two side perforated lines, respective rectangular extensions which will form a skirt-like front part and rear part of the upper surface itself emerging from the side perforated lines, whereas the sides occupying the entire height of the bottoms or bases of the box also have side extensions for forming a front and rear flap between the lower edge and the upper edge of the lid.

Between those sides, the upper surface and both the side extensions and upper skirts form a housing means for the box itself, regardless of whether the latter is formed by a single body or base or by two independent bases or bottoms, being fixed by means of gluing and allowing opening through the perforated lines of the upper surface of the lid either for accessing either bottom or for accessing the base or bottom if there is only one of them, and allowing removing the content from that corresponding bottom or base in any case.

In turn, the prismatic body defining each of the bottoms or the only bottom is also formed from a rectangular sheet with folding lines demarcating a central sector forming the bottom itself, two larger side sectors corresponding to the sides of the box, and four end and side sectors which will form the halves of the front and rear sides of the corresponding base or box when forming the box, being complemented with intermediate side sectors derived from the bottom sector for assembling the box by means of folding over the outer portion of the front and rear sectors, and thus forming the rectangular prismatic body of the base or box itself, either as a single body or as two independent bodies or bases.

The two bases will therefore be superimposed collateral to one another forming a single block but with two compartments, one for each base, for containing identical or different products, whereas when it comes to a single body or box, the capacity will double and in any case the lid as an independent element covers and partially surrounds that body or bodies forming the previously described bases or bottoms.

An opening has been envisaged in correspondence with the transverse perforated line of the central sector forming the upper surface of the lid to facilitate opening each body of the box by tearing, since during marketing and handling the lid and the body or bodies forming the box are attached to one another by means of gluing, forming a single block which can be handled manually by means of manually gripping the two windows established in correspondence with the transverse punched hole of the upper surface of the lid.

The assembly offers a high resistance to stacking since the sides of the lid with the extensions thereof form strong columns during stacking, furthermore being suitable for transport in humid environments, and even being able to be customized according to customer requirements and requests.

DESCRIPTION OF THE DRAWINGS

To complement the following description and for the purpose of aiding to better understand the features of the invention according to a preferred practical embodiment thereof, a set of drawings is attached as an integral part of said description in which the following is depicted with an illustrative and non-limiting character.

PREFERRED EMBODIMENT OF THE INVENTION

Figure 2:
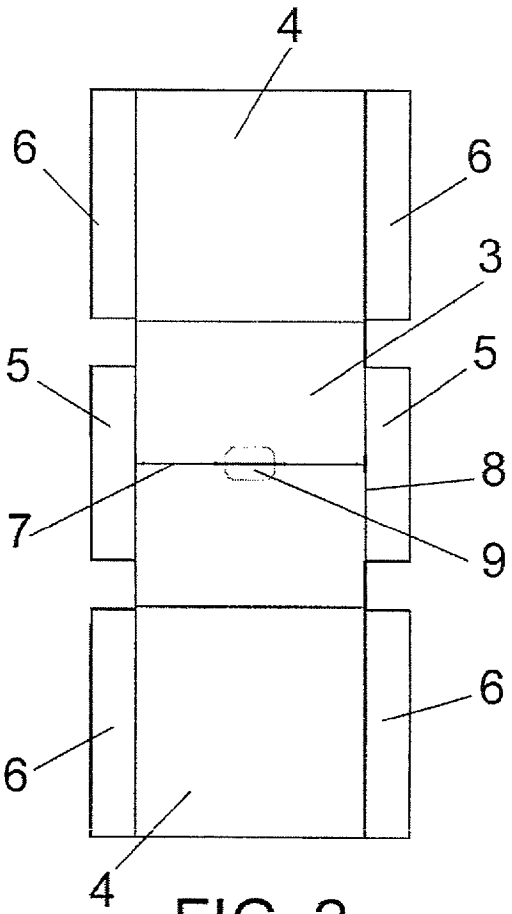
FIG. 2 shows a view corresponding to the net of the sheet from which the lid of the box object of the invention is obtained.

As can be seen in the drawings referred to above, the box of the invention includes in the present example two identical bodies (1) having a rectangular prismatic configuration, and a lid (2) provided for jointly closing the upper open base of those bodies (1) forming respective bases of the box.

Figure 3:
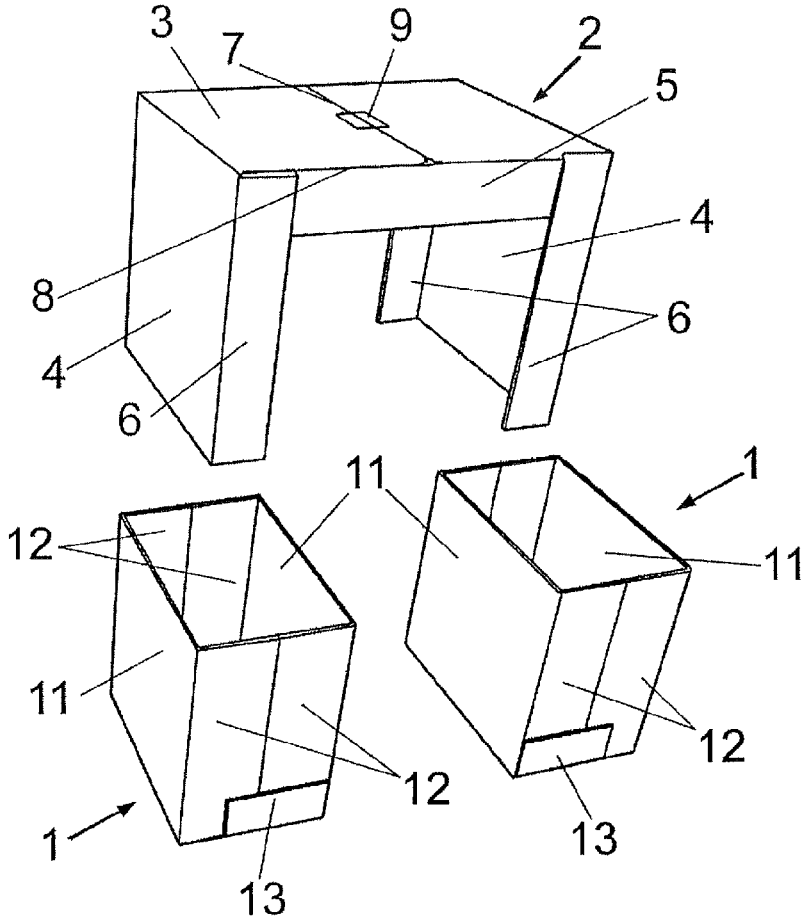
FIG. 3 shows a perspective view of the three parts forming the assembly of the box, showing on one hand the lid and on the other hand the two prismatic bodies which must be jointly housed inside the lid.

In any case, the lid (2) is obtained from the net of a rectangular cardboard sheet as depicted in FIG. 2, in which there are folding lines demarcating a central sector (3) which will form the upper surface of the lid (2), likewise defining two side sectors (4) which will form the larger sides of said lid (2), as depicted in FIG. 3, both the central sector (3) corresponding to the upper surface of the lid (2) and the side sectors (4) having respective extensions (5, 6) which will form front and rear skirts of the lid (2) in the first case, and front and rear vertical flaps of the side sectors (4) of the lid (2) itself, as shown in FIG. 3.

Figure 4:
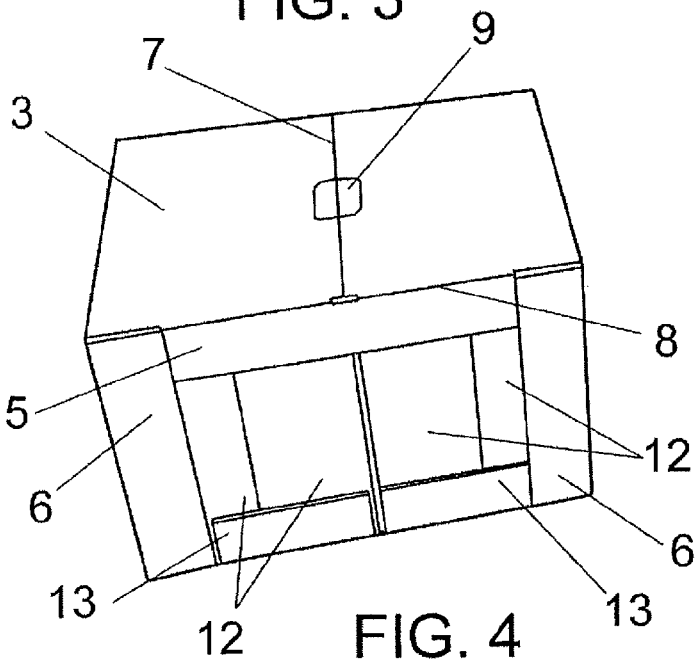
FIG. 4 shows a top perspective view of the assembly depicted in the preceding figure, forming a single block for handling and transport.

Furthermore, the central sector (3) corresponding to the upper surface of the lid (2) has an intermediate transverse perforated line (7) shown in FIGS. 2 to 4 and two side perforated lines (8), said perforated lines (7, 8) being envisaged to allow tearing the upper surface of the lid (2) and to enable accessing the inside of each of the bodies (1) forming the box itself.

The lid (2) itself also has an intermediate punched hole or opening (9) for manually gripping and handling the assembly formed by said lid (2) with the bodies (1) as depicted in FIG. 4.

Figure 1:
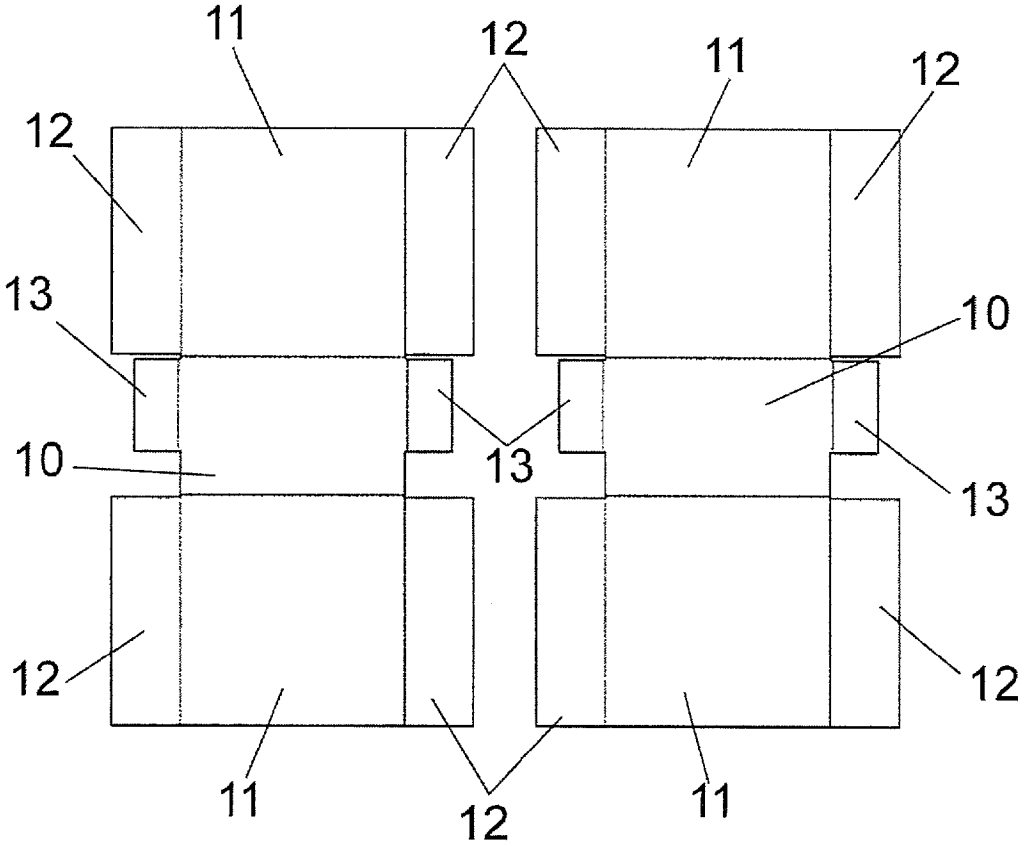
FIG. 1 shows a plan view of two cardboard sheets which will form respective independent bases or bodies of the box in this case.

In turn, each of the bases or bodies (1) is also formed from the net of a rectangular sheet shown in FIG. 1 in which two nets corresponding to the bodies (1) themselves depicted in FIG. 3 are shown, since in this case the box will be formed by two identical bodies (1) having a rectangular prismatic configuration and both bodies (1) will be housed in and covered by the lid (2), i.e., enclosed in the lid (2), to which they are fixed by means of gluing for forming a single block as depicted in FIG. 4 which can be manually handled by gripping the punched holes or openings (9) of the upper surface of the lid (2).

In any case, the cardboard sheet which will form each body (1) has cutting and folding lines for forming a central sector (10) shown in FIG. 1 which will correspond to the bottom when assembling the body (1), and two end sectors (11) which will correspond to the larger sides of each of the bodies (1).

Both end sectors (11) corresponding to the larger sides of each body (1) in turn prolong into side extensions (12) the width of which is preferably half the width of the body (1), so the pair of side extensions (12) will form the front and rear end parts of each prismatic body (1) of the box as depicted in FIGS. 1 and 3.

Once the bodies (1) have been assembled through the folding lines demarcating the sectors (10, 11 and 12), both the front-rear sides and sides are maintained by means of extensions (13) derived from the central sector (10), such that those extensions (13) are arranged against and fixed to the side extensions (12) which will form the front and rear sides of the body (1) of the box by means of gluing.

A box with lid (2) is therefore obtained in which the box itself can be formed by a single body the net of which would correspond to the joint net of the cardboard sheets forming each body (1), or the box is formed by two independent and identical bodies (1) having a rectangular prismatic configuration obtained from each of the nets shown in FIG. 1, which when being assembled form the rectangular prismatic bodies (1) that are open in the upper portion and arranged against and fixed collateral to one another, being laterally covered and closed by means of the lid (2) which is perfectly adapted and fixed to those bodies (1) also by gluing to form the block depicted in FIG. 4, in which there are two box bodies (1) which can be accessed simultaneously or independently by tearing along the transverse perforated line (7) and along one or of both parts of the side perforated line (8).

The invention claimed is:

1. Box with lid comprising two independent bodies having a rectangular prismatic configuration which are jointly closed by means of a lid, said box being characterized in that:

each independent body is provided with cutting and folding lines demarcating a first central sector forming the bottom of the body, and a pair of end sectors corresponding to larger sides of the body;

wherein the end sectors of each body additionally comprise side extensions forming front and rear end parts of the said body;

wherein the side extensions forming the front and rear end parts of the said body do not overlap;

wherein the first central sector additionally comprises intermediate extensions which are arranged against and fixed to the side extensions;

and wherein the intermediate extensions are arranged against and fixed to the side extensions forming the front and rear parts of the said body of the box by gluing;

the lid is an independent element with respect to the independent bodies, wherein said lid covers and partially surrounds the said independent bodies, said lid also being provided with cutting and folding lines demarcating a second central sector forming an upper surface of the lid, and a pair of side sectors corresponding to larger sides of the lid, the second central sector has a transverse perforated line and two side perforated lines to allow opening the entire lid or part thereof; wherein the transverse perforated line is intermediately arranged between the two independent bodies so that they can be accessed independently or simultaneously by tearing along the transverse perforated line and along the side perforated lines over, respectively, one or two of said independent bodies the second central sector and the side sectors of the lid additionally comprise extensions forming front and rear skirts of the lid, respectively, and front and rear vertical flaps of the side sectors of the lid itself, wherein said vertical flaps occupy the entire height of the box;

the vertical flaps and the skirts of the lid do not overlap and cover the entire front and rear lengths of the second central sector;

the vertical flaps of the lid and the intermediate extensions of the two independent bodies do not overlap and cover the entire front and rear length of the first central sector.

2. Box with lid according to claim 1, characterized in that the side extensions have a width that is half the width of each independent body.

3. Box with lid according to claim 1, characterized in that the lid additionally comprises an opening for manually gripping and handling the assembly formed by the lid with the at least one body.

4. Box with lid according to claim 1, characterized in that both the at least one body and the lid are made of a cardboard sheet.

* * * * *